US006648152B2

(12) United States Patent
Bermes

(10) Patent No.: US 6,648,152 B2
(45) Date of Patent: Nov. 18, 2003

(54) CHAIN SAW HOLDER

(75) Inventor: Steven P. Bermes, Fort Wayne, IN (US)

(73) Assignee: Novae Corporation, Grabill, IN (US)

( * ) Notice: Subject to any disclaimer, the term of this patent is extended or adjusted under 35 U.S.C. 154(b) by 0 days.

(21) Appl. No.: 09/906,563

(22) Filed: Jul. 16, 2001

(65) Prior Publication Data

US 2003/0010734 A1 Jan. 16, 2003

(51) Int. Cl.[7] ..... A47F 5/00

(52) U.S. Cl. ..... 211/70.6; 211/175; 224/403; 248/218.4; 248/316.4; 248/287.1; 248/297.21

(58) Field of Search ..... 211/70.6, 70.7, 211/60.1, 70.1; 248/176.1, 309.1, 658, 670, 674, 37.3, 37.6, 122.1, 274.1, 298.1; 30/123.4, 166.3, 373, 507, 510–511; 224/441, 443, 446, 281, 501, 522–525, 531, 533, 536–537, 324, 330, 545, 547, 552, 555, 558, 564–565, 567, 570–571

(56) References Cited

U.S. PATENT DOCUMENTS

| | | | | | |
|---|---|---|---|---|---|
| 2,357,646 | A | * | 9/1944 | Gilbert | |
| 2,933,278 | A | * | 4/1960 | Heise | 248/176.1 |
| 3,776,437 | A | * | 12/1973 | Carney | 211/70.5 |
| 3,893,568 | A | | 7/1975 | Lile | |
| 3,980,217 | A | * | 9/1976 | Yochum | 211/70.6 |
| 4,369,575 | A | | 1/1983 | Schurman | |
| 4,473,176 | A | | 9/1984 | Harper | |
| 4,846,385 | A | | 7/1989 | Fratus | |
| 4,907,778 | A | * | 3/1990 | Rockwell | 24/327 |
| 5,007,568 | A | | 4/1991 | Da Vault | |
| 5,476,203 | A | * | 12/1995 | Fletcher | 211/22 |
| 5,647,489 | A | | 7/1997 | Bellis, Jr. | |
| 5,676,257 | A | * | 10/1997 | Adkins | 211/4 |
| RE35,677 | E | * | 12/1997 | O'Neill | 248/551 |
| 5,779,120 | A | * | 7/1998 | Morford | 224/311 |
| 5,884,681 | A | * | 3/1999 | Nickles | 144/286.1 |
| 6,129,252 | A | * | 10/2000 | Jackson et al. | 114/351 |
| 6,142,349 | A | * | 11/2000 | Roberson | 224/401 |
| 6,173,842 | B1 | | 1/2001 | Fitzgerald | |
| 6,250,400 | B1 | * | 6/2001 | Bucko | 173/171 |
| 6,302,280 | B1 | * | 10/2001 | Bermes | 211/175 |
| 6,409,028 | B2 | * | 6/2002 | Nickerson | 108/61 |
| 6,409,029 | B1 | * | 6/2002 | Bermes | 211/207 |

* cited by examiner

*Primary Examiner*—Blair M. Johnson
*Assistant Examiner*—Jennifer E. Novosad
(74) *Attorney, Agent, or Firm*—George Pappas

(57) ABSTRACT

A chain saw holder for supporting and selectively locking a chain saw to a vehicle such as a trailer, truck, van, etc. The holder includes a cutter bar retaining portion for frictionally engaging the chain saw cutter bar and a handle retaining portion for selectively receiving and capturing the chain saw elongate front handle. A stop member is selectively moveable along an elongate arm for selective placement over the U-shaped section and capturing the chain saw handle.

21 Claims, 4 Drawing Sheets

CHAIN SAW HOLDER

TECHNICAL FIELD

The present invention relates to the field of apparatus for supporting and transporting chain saws. More particularly, the present invention relates to a chain saw holder which can be mounted on a support structure such as a trailer, truck, van, etc., and whereupon a chain saw is selectively mounted for storage and transport.

BACKGROUND OF THE INVENTION

Chain saws are today very commonly used in various industries including grounds and tree maintenance, construction, and logging. Chain saws are typically powered with a gas engine and include a cutter bar which is mounted on and extends from the engine. A cutting chain is slidingly driven around the cutter bar. Chain saws further typically include a front elongate handle and a rear handle for grasping and operating. The front handle is typically elongate, having a horizontal portion above and to one side of the cutter bar, and a vertical portion opposite the cutter bar location. The rear handle is typically located at the rear of the chain saw engine and includes a throttle for controlling the engine speed.

In view of their shape, chain saws are generally difficult to store and transport in a manner whereby they will not be damaged and/or whereby the chain saw teeth will not cause damage to other items being transported therewith. This is particularly problematic in the tree cutting, grounds maintenance and construction industries which require the chain saws to be transported on vehicles such as trailers, trucks or vans between job sites. Furthermore, while parked chain saws which are not secured to the vehicle may be stolen.

Various apparatus for supporting and transporting chain saws have previously been devised and used. Most common is probably a chain saw case which completely surrounds and encloses a chain saw. Although this adequately protects the chain saw, it is typically relatively difficult to place and quickly remove the saw from the case and, more importantly, does not provide a means for securing to the vehicle and preventing the saw and case from sliding or rolling in the vehicle while in transit.

Other known chain saw supporting devices include those shown and disclosed by Harper, U.S. Pat. No. 4,473,176 and Shurman, U.S. Pat. No. 4,369,575. Although the devices of these patents appear to adequately support chain saws for transport, they are not easily capable of use with various different types and sizes of chain saws.

Accordingly, a need exists for a chain saw holder for efficiently and properly supporting and storing chain saws on transport vehicles and, further, wherein the chains saws can relatively easily and quickly be placed on and removed from the holder.

SUMMARY OF THE INVENTION

It is the principal object of the present invention to overcome the above discussed disadvantages associated with prior chain saw holding and storing devices and which fullfills the desired above discussed needs.

The chain saw holder, in accordance with the principles of the present invention, in general, includes a base adapted to be mounted to a support structure including transport vehicles such as trailers, trucks and vans. A cutter bar retaining portion is attached to and extends from the base and includes a slot for receiving the chain saw cutter bar. Flexible rubber grommets are attached to the cutter bar retaining portion adjacent to and extending into the slot whereby, upon insertion, the chain saw cutter bar is frictionally engaged by the rubber grommets.

A handle retaining portion is also attached to and extends from the base, and includes a handle capture portion adapted to selectively receive and retain the forward elongate chain saw handle located adjacent and to the side of the cutter bar. Preferably, the handle capture portion includes a horizontally disposed U-shaped section for receiving the generally vertical portion of the chain saw elongate handle. The U-shaped section further includes an elongate arm extending generally horizontally. A stop member is provided and is slidingly moveable along the arm for selectively securing and capturing the chain saw handle within the U-shaped section. The stop member can be selectively locked along the elongate arm for thereby locking the chain saw handle within the U-shaped section.

The cutter bar retaining portion is slidingly attached to the base for selectively adjusting the distance between the cutter bar retaining portion and the handle retaining portion. In this manner, various types and sizes of chain saws having various distances between the cutter bar and vertical portion of the front handle can be accommodated.

In one form thereof, the present invention is directed to a chain saw holder for supporting a chain saw having a cutter bar and an elongate handle. The chain saw holder includes a base and a cutter bar retaining portion extending from the base and having a slot for receiving a chain saw cutter bar. A handle retaining portion is also provided and extends from the base and has a handle capture portion selectively receiving and retaining a chain saw elongate handle.

Preferably, flexible members are provided on the cutter bar retaining portion extending into the slot whereby the chain saw cutter bar is selectively frictionally engaged. The cutter bar retaining portion is further preferably slidingly attached to the base whereby the distance between the cutter bar retaining portion and the handle retaining portion is adjustable. Yet more preferably, the handle capture portion includes a horizontally disposed U-shaped section adapted to receive a vertical portion of a chain saw elongate handle and a stop member is slidingly moveable along an arm extending from the U-shaped section for thereby selectively capturing the chain saw elongate handle.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE PREFERRED EMBODIMENTS

Figure 1:
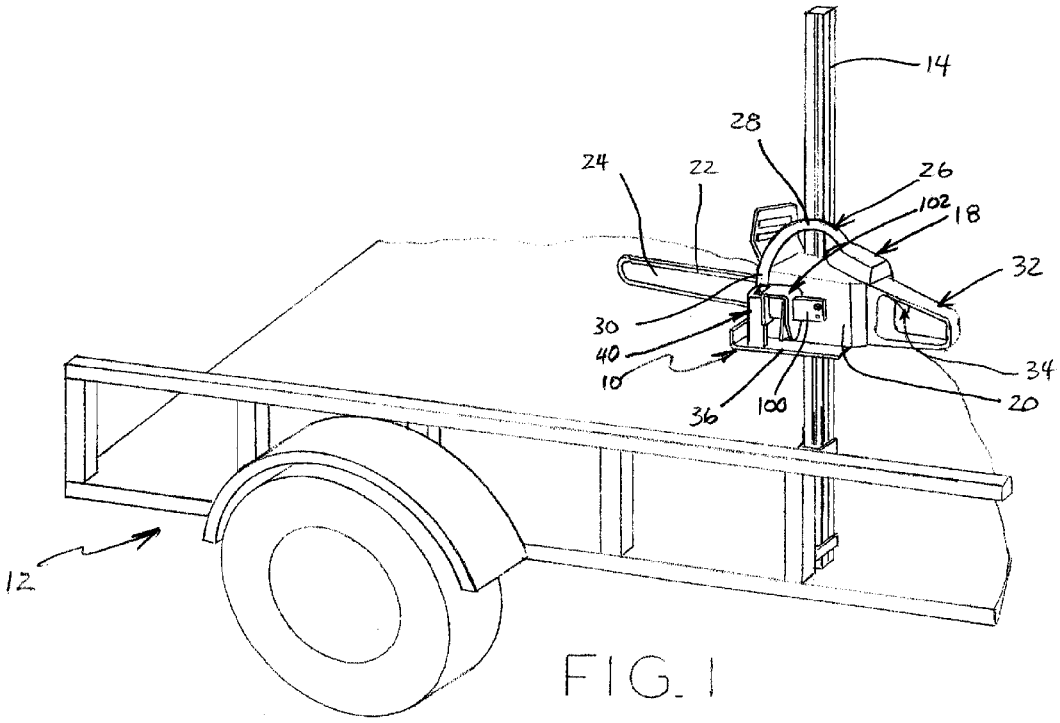
FIG. 1 is a perspective view of a chain saw holder constructed in accordance with the principles of the present invention and mounted on a vertical post attached to a trailer.
Figure 3:
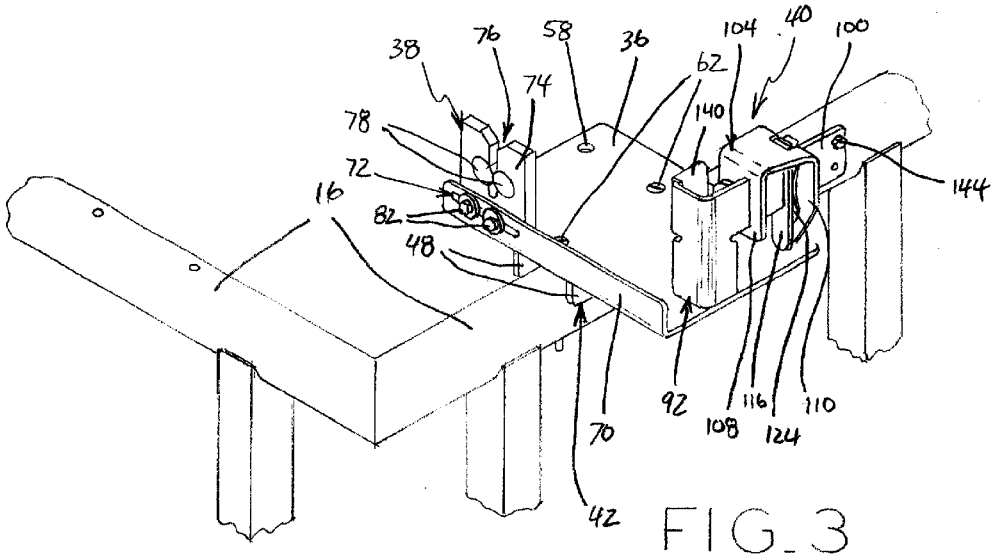
FIG. 3 is a perspective view of a chain saw holder constructed in accordance with the principles of the present invention and mounted to a horizontal portion of a trailer.

Referring initially to FIGS. 1 and 3, a chain saw holder constructed in accordance with the principles of the present invention is shown and generally designated by the numeral 10. Chain saw holder 10 is preferably detachably attachable to a support structure such as trailer 12, for example, via a vertical post 14 attached to the trailer 12, or directly to a horizontal tube 16 making up part of the trailer structure. In this manner, a chain saw 18 can quickly be placed on and accessed from the chain saw holder 10.

It is noted that chain saw 18 typically includes a gas engine 20 adapted to drive a cutting chain 22 around the cutter bar 24. A front handle 26 is generally elongate as shown and includes a horizontal portion 28 and a vertical portion 30. Front handle 26, as shown, typically is located adjacent and to the side of the cutter bar 24. A rear handle 32 is provided at the rear of the chain saw along with a speed control or trigger 34. As will more fully be described hereinbelow, chain saw 18 is supported and retained on the chain saw holder 10 by setting the chain saw on the base 36, and securing the cutter bar 24 with a cutter bar retaining portion 38 and securing the front handle 26 with a handle retaining portion 40.

Figure 6:
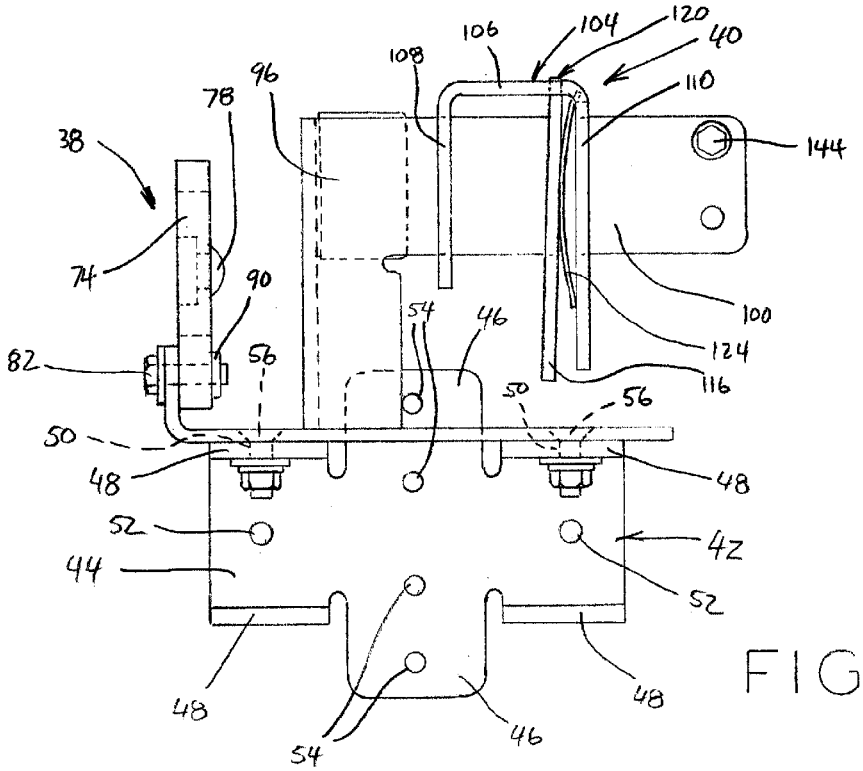
FIG. 6 is a side elevation view of the chain saw holder shown in FIG. 5.

Chain saw holder 10 is detachably attachable to the vertical post 14 or the trailer horizontal tube 16 with a bracket 42. Bracket 42 includes a central flat 44 from which extend integrally formed parallel ears 46 and perpendicular ears 48. As best seen in FIG. 6, holes 50 are provided in the upper perpendicular ears 48; holes 52 are provided in the central flat 44 generally between and parallel with perpendicular ears 48; and, holes 54 are provided along the parallel ears 46 and central flat 44 between the perpendicular ears 48.

Figure 2:
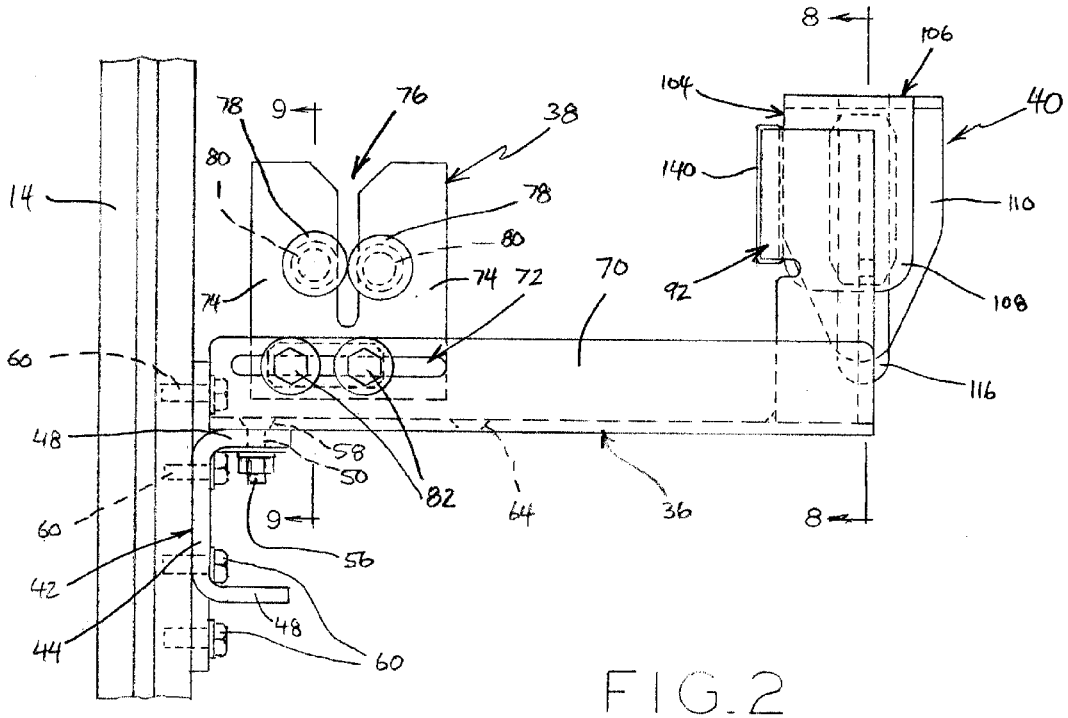
FIG. 2 is a front elevation view of the chain saw holder shown in FIG. 1.

For attaching chain saw holder 10 to vertical post 14, bracket 42 is attached to the base 36, as best seen in FIGS. 2 and 6, with screws 56 extending through holes 50 in ears 48 and holes 58 through base 36. Central flat 44 and parallel ears 46 are then placed against post 14, and bracket 42 is attached thereto vertically at any desired height in a known and customary manner, and by using screws 60 extending through holes 54.

Figure 4:
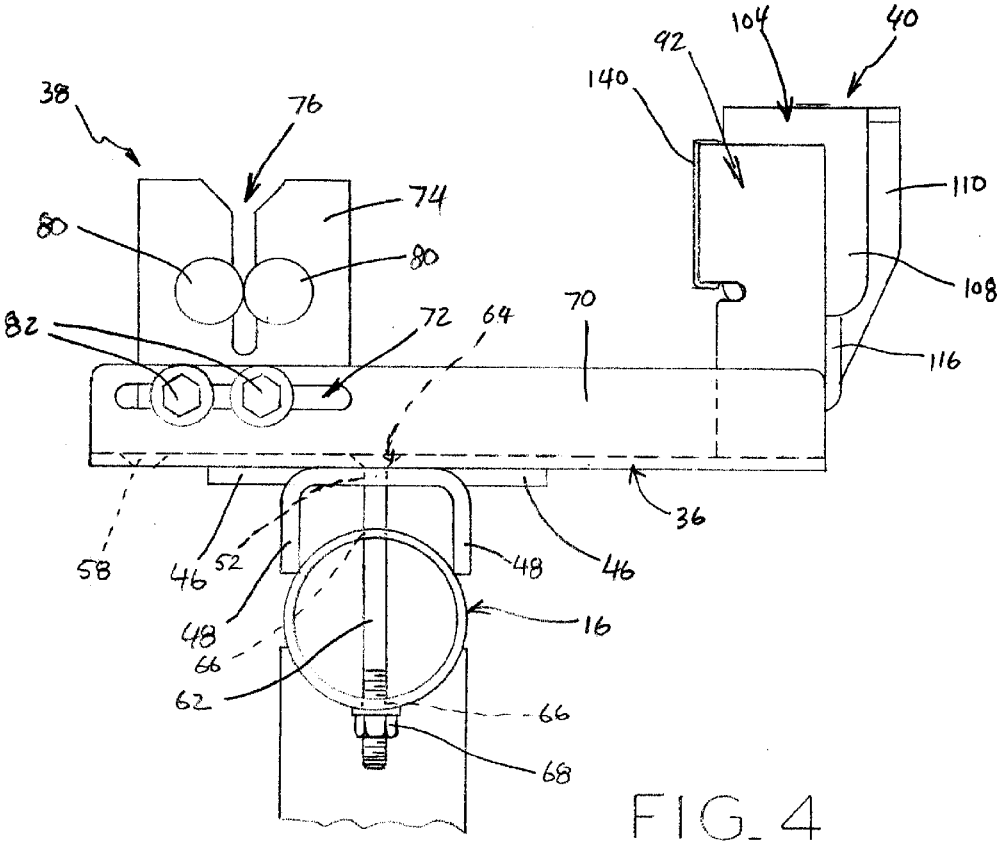
FIG. 4 is a front elevation view of the chain saw holder shown in FIG. 3.
Figure 5:
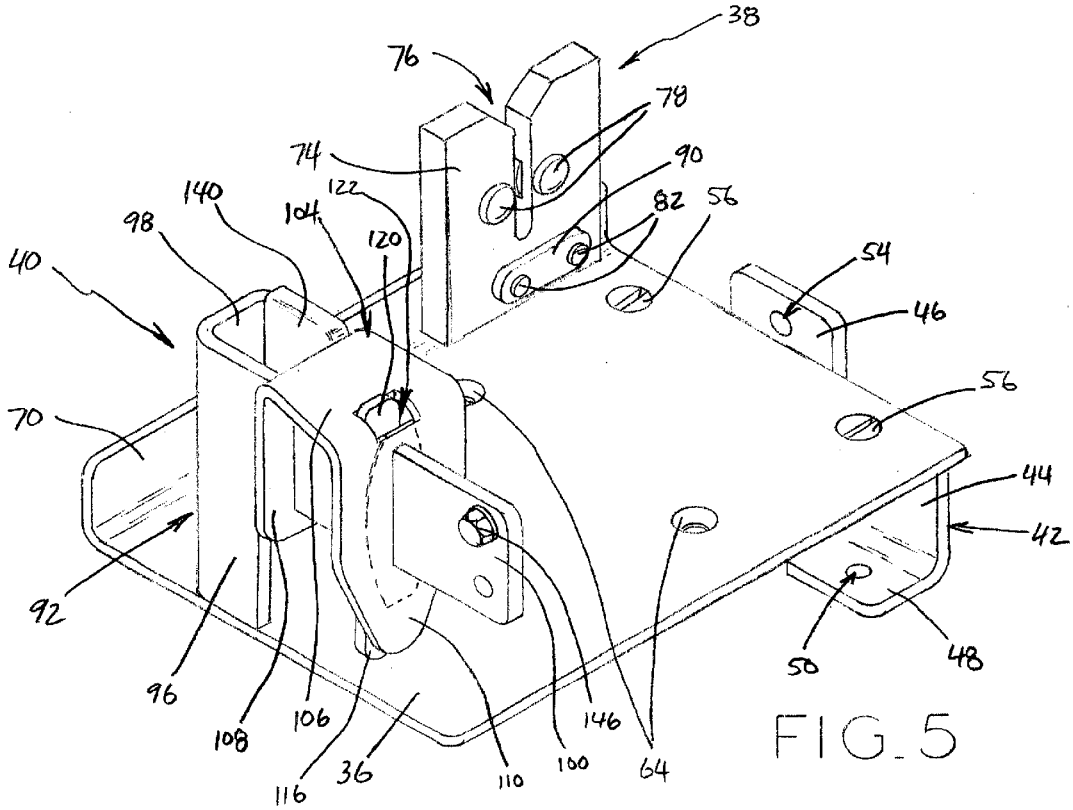
FIG. 5 is a rear perspective view of the chain saw holder shown in FIG. 1.

For attaching the chain saw holder 10 to a horizontal trailer tube 16, bracket 42 is turned placing parallel ears 46 and central flat 44 parallel with base 36 and underneath thereof as best seen in FIG. 4. Screws are inserted through the holes 64 in base 36, the holes 52 in central flat 44 and the holes 66 through horizontal tube 16. A nut 68 is threadingly received at the end of screw 62 forcing perpendicular ears 48 downwardly on top of horizontal tube 16 as shown in FIG. 4, and thereby securing base 36 and chain saw holder 10 to the horizontal tube 16 of trailer 12. As can be appreciated, by utilizing the same bracket 42 for attachment to either vertical post 14 or horizontal tube 16, manufacturing and overall costs are decreased.

For attachment of the cutter bar retaining portion 38 to base 36, base 36 is provided with an integrally formed lip 70. A slot 72 extends through and generally parallel with lip 72. Cutter bar retaining portion 38 further includes a vertical plate 74 wherein there is formed a cutter bar receiving slot 76. Rubber grommets 78 are provided and are attached to the plate 74 on the sides of slot 76 by insertion and frictional engagement into holes 80 located on the sides of slot 76 and through plate 74. Rubber grommets 80 are flexible and extend into slot 76 so that, upon insertion, the cutter bar 24 is frictionally engaged between the rubber grommets 80. It is noted that plate 74 is preferably made of high density polyethylene and, therefore, together with flexible rubber grommets 80, damage to the cutter bar 24 and cutting chain 22 is prevented while positive frictional engagement is provided.

Figure 7:
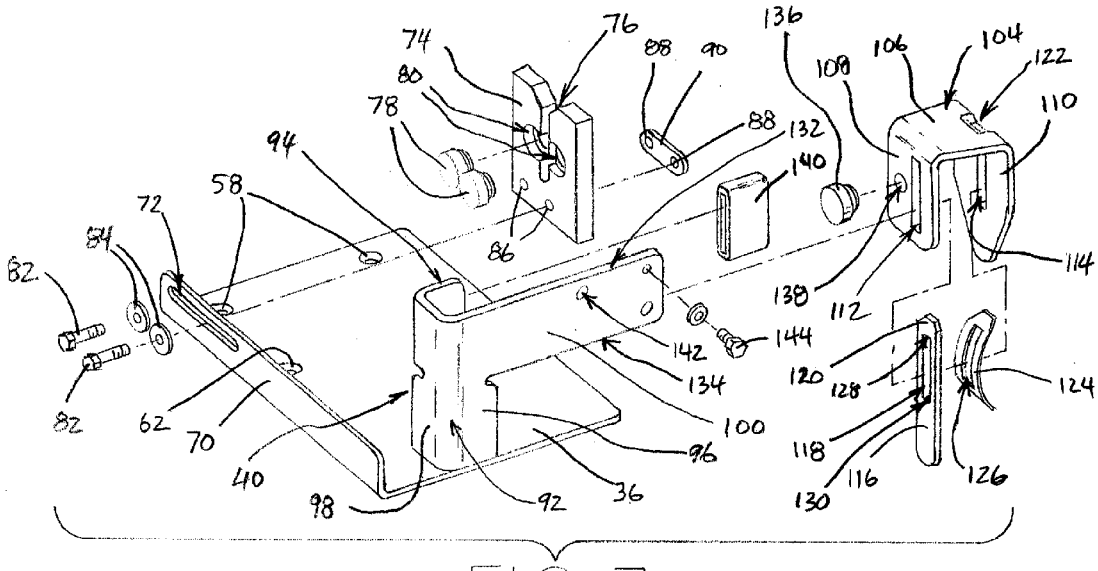
FIG. 7 is an exploded perspective view of a chain saw holder constructed in accordance with the principles of the present invention.
Figure 8:
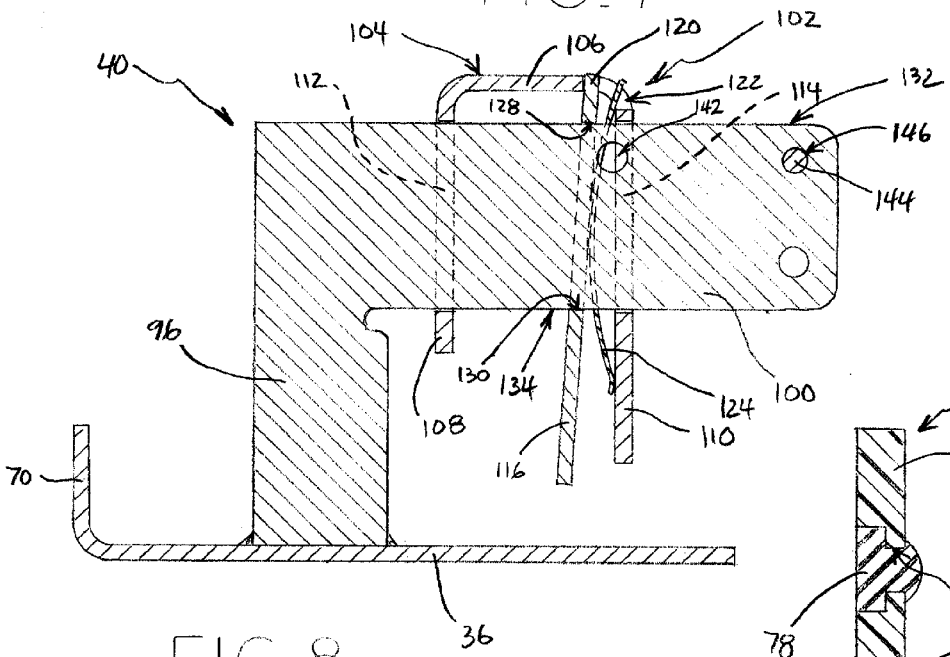
FIG. 8 is a cross sectional view taken generally along line 8—8 of FIG. 2; and, FIG. 9 is a cross sectional view taken generally along line 9—9 of FIG. 2.
Figure 9:
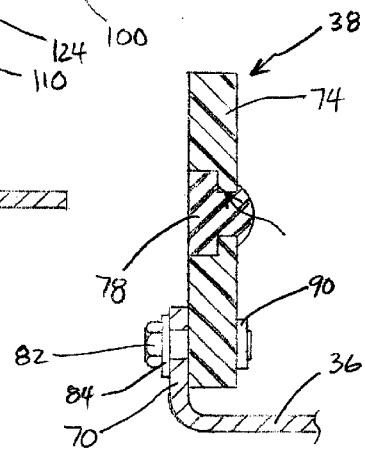

Plate 74 is attached to lip 70 using a pair of screws 82 which, as best seen in FIG. 7, extend through washers 84, slot 74, holes 86, and finally, are threadingly received into threaded holes 88 extending through backing member 90. As should now be evident, by selectively loosening and tightening screws 82, the horizontal position of vertical plate 74 can be selectively adjusted horizontally along the length of slot 72. In this manner, the distance between the cutter bar receiving slot 76 and the handle retaining portion 40 is selectively adjustable for accommodating various types and sizes of chain saws having differing distances between their cutter bars and front handle.

For securing the chain saw front handle 26, the handle retaining portion 40 includes a handle capture portion which preferably includes an upstanding U-shaped section 92 comprising legs 94 and 96 extending from central section 98. As best seen in FIG. 1, the vertical portion 30 of the front handle 26 is received within the U-shaped section 92 between legs 94 and 96 and adjacent central section 98. U-shaped section 92, as well as the base 36, are preferably made of steel and U-shaped section 92 is preferably welded extending generally perpendicular from base 36 as shown, thereby placing the U-shaped section and arms 94 and 96 thereof in a generally horizontally disposed position for receiving the vertical portion 30 of front handle 26.

U-shaped section 92 includes an elongate arm 100 preferably co-planer and integrally formed with leg 96 for extending beyond leg 96 as shown. A stop member generally designated by the numeral 102, as more fully described hereinbelow, is slidingly moveable along arm 100 for selectively capturing the vertical portion 30 of front handle 26. Stop member 102 includes a U-shaped collar 104 having a central portion 106 and front and rear legs 108 and 110. A vertically extending slot 112 is provided through front leg 112 and a vertically extending slot 114 is provided through leg 110. As shown, slots 112 and 114 are adapted to receive elongate arm 100 therethrough and thereby allow collar 104 to freely slide along elongate arm 100.

A latch member 116 is generally elongate as shown, and also includes a slot 118 for receiving arm 100. When latch member 116 is received on arm 100 and within collar 104, the upper portion 120 thereof projects upwardly and into aperture 122. A spring member 124 made of spring steel also includes a slot 126 for receiving arm 100 therethrough. Spring member 124 is placed between rear leg 110 of collar 104 and latch member 116 and serves to urge latch member 116 away from rear leg 110 for causing the upper and lower surfaces 128 and 130 of latch slot 118 to contact and selectively frictionally engage or bind against the upper and lower surfaces 132 and 134 of elongate arm 100. Accordingly, by selectively urging latch member 116 against the force of spring 124 toward rear leg 110, latch member upper and lower surfaces 128 and 130 are no longer forced against the upper and lower surfaces 132 and 134 of arm 100 thereby allowing the collar 104, latch member 116, and spring 124 to freely slide back and forth along arm 100. However, upon release of latch member 116, spring 124 again causes the latch member 116 to bind against arm 100 thereby causing collar 104 to be retained at that horizontal position. As should now be appreciated, by placing a chain saw 18 with its cutter bar 24 in the cutter bar receiving slot 76 and the vertical portion 30 of front handle 26 within U-shaped section 92, the chains saw 18 can be secured in place by merely selectively moving the stop member collar 104 against or away from the legs 94 and 96 for thereby selectively capturing the handle within the U-shaped section 92.

A rubber grommet 136 is attached to the front leg 108 of collar 106 by frictional engagement within a hole 138 through front leg 108. Rubber grommet 136 is located as shown for contacting the vertical portion 30 of front handle 26 and preventing potential damage thereto. Additionally, a rubber cap 140 is received over leg 94 of U-shaped section 92 for also contacting the vertical portion 30 of front handle 26 and preventing potential damage thereto.

A hole 142 is provided through elongate arm 100 and is sized and adapted to receive a common padlock (not shown). In this manner, when the vertical portion 30 of handle 26 is captured within U-shaped section 92 with stop member 102, a padlock can be placed through hole 142 for locking the stop member in position and preventing potential theft of the chain saw. Additionally, a screw 144 is secured on the elongate arm 100 near the terminal end thereof through hole 146. Screw 144 contacts the rear leg 110 as collar 104 is slid toward the terminal end of arm 100 and thereby preventing collar 104 from inadvertently being removed therefrom.

It is noted that base 36, bracket 42, U-shaped section 92, U-shaped collar 104, and latch member 116 are preferably made of galvanized steel and formed as shown.

While this invention has been described as having specific embodiments, it will be understood that it is capable of further modification. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. In combination, a chain saw holder and a chain saw having a cutter bar with a cutting chain slidingly driven around the cutter bar and an elongate handle adjacent and to the side of the cutter bar, said chain saw holder comprising:

a base;

a cutter bar retaining portion extending from said base and having a slot for receiving the chain saw cutter bar; and, a handle retaining portion extending from said base and having a handle capture portion selectively receiving the chain saw elongate handle and having a stop member retaining the chain saw handle therein.

2. The chain saw holder of claim 1 wherein the distance between said cutter bar retaining portion and said handle retaining portion is selectively adjustable.

3. The chain saw holder of claim 1 further comprising flexible members on said cutter bar retaining portion extending into said slot whereby the chain saw cutter bar is selectively frictionally engaged.

4. The chain saw holder of claim 3 wherein said flexible members are rubber grommets.

5. The chain saw holder of claim 1 wherein said cutter bar retaining portion is slidingly attached to said base, whereby the distance between said cutter bar retaining portion and said handle retaining portion is adjustable.

6. The chain saw holder of claim 5 further comprising flexible members on said cutter bar retaining portion extending into said slot whereby the chain saw cutter bar is selectively frictionally engaged.

7. The chain saw holder of claim 1 wherein said handle capture portion includes a U-shaped section adapted to receive the chain saw elongate handle.

8. The chain saw holder of claim 7 wherein said stop member is selectively slidingly moveable over said U-shaped section, whereby the chain saw elongate handle is selectively captured.

9. The chain saw holder of claim 8 wherein said U-shaped section includes an elongate arm, and wherein said stop member is slidingly moveable along said elongate arm.

10. The chain saw holder of claim 9 wherein said U-shaped section is generally horizontally disposed, whereby a generally vertical portion of a chain saw elongate handle is selectively received and retained.

11. The chain saw holder of claim 7 wherein said U-shaped section is generally horizontally disposed, whereby a generally vertical portion of a chain saw elongate handle is selectively received and retained.

12. The chain saw holder of claim 11 wherein said cutter bar retaining portion is slidingly attached to said base, whereby the distance between said cutter bar retaining portion and said handle retaining portion is adjustable.

13. The chain saw holder of claim 12 wherein said stop member is selectively slidingly moveable over said U-shaped section, whereby the chain saw elongate handle is selectively captured.

14. The chain saw holder of claim 12 further comprising flexible members on said cutter bar retaining portion extending into said slot whereby the chain saw cutter bar is selectively frictionally engaged.

15. The chain saw holder of claim 7 wherein the distance between said cutter bar retaining portion and said handle retaining portion is selectively adjustable.

16. The chain saw holder of claim 1 wherein said base is detachably attachable to a support structure.

17. The chain saw holder of claim 16 wherein said handle capture portion includes a U-shaped section adapted to receive the chain saw handle and wherein said U-shaped section is generally horizontally disposed, whereby a generally vertical portion of the chain saw elongate handle is selectively received and retained in said U-shaped section.

18. The chain saw holder of claim 17 wherein said stop member is selectively slidingly moveable over said U-shaped section, whereby the chain saw elongate handle is selectively captured.

19. The chain saw holder of claim 17 wherein said cutter bar retaining portion is slidingly attached to said base, whereby the distance between said cutter bar retaining portion and said handle retaining portion is adjustable.

20. The chain saw holder of claim 16 wherein said cutter bar retaining portion is slidingly attached to said base, whereby the distance between said cutter bar retaining portion and said handle retaining portion is adjustable.

21. The chain saw holder of claim 1 further comprising means for attaching said base to one of a vertical or horizontal support structure.

* * * * *